US007946691B2

(12) United States Patent
Griffin et al.

(10) Patent No.: US 7,946,691 B2
(45) Date of Patent: May 24, 2011

(54) DEFLECTION DEVICE INCLUDING EXPANSION AND CONTRACTION REGIONS

(75) Inventors: Todd R. Griffin, Webster, NY (US); David L. Jeanmaire, Brockport, NY (US); David J. Nelson, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 394 days.

(21) Appl. No.: 12/265,146

(22) Filed: Nov. 5, 2008

(65) Prior Publication Data

US 2010/0110151 A1 May 6, 2010

(51) Int. Cl.
*B41J 2/02* (2006.01)
*B41J 2/07* (2006.01)
*B41J 2/185* (2006.01)

(52) U.S. Cl. ..... 347/73; 347/74; 347/90

(58) Field of Classification Search ..... 347/73, 347/74–82, 90

See application file for complete search history.

(56) References Cited

U.S. PATENT DOCUMENTS 3,906,588 A 9/1975 Zafiroglu
4,068,241 A 1/1978 Yamada
4,097,872 A 6/1978 Giordano et al.
4,281,540 A 8/1981 Lee et al.
4,297,712 A 10/1981 Lammers et al.
4,638,327 A 1/1987 Sutera et al.
5,564,630 A 10/1996 Giles et al.
5,778,494 A 7/1998 Freund et al.
6,457,807 B1 10/2002 Hawkins et al.
6,491,362 B1 12/2002 Jeanmaire
6,505,921 B2 1/2003 Chwalek et al.
6,554,410 B2 4/2003 Jeanmaire et al.
6,575,566 B1 6/2003 Jeanmaire et al.
6,588,888 B2 7/2003 Jeanmaire et al.
6,688,736 B1 * 2/2004 Tunmore et al. ..... 347/90
6,793,328 B2 9/2004 Jeanmaire
6,827,429 B2 12/2004 Jeanmaire et al.
6,851,796 B2 * 2/2005 Jeanmaire et al. ..... 347/74
2004/0004928 A1 1/2004 Choi
2005/0195521 A1 9/2005 Alonso et al.
2010/0295910 A1 * 11/2010 Xie et al. ..... 347/90

* cited by examiner

*Primary Examiner* — K. Feggins
(74) *Attorney, Agent, or Firm* — William R. Zimmerli

(57) ABSTRACT

A method of printing and a printhead are provided. The printhead includes a nozzle array having a width; a gas flow source; and a gas flow duct in fluid communication with the gas flow source. The gas flow duct includes an expansion region and a compression region. The expansion region of the gas flow duct gradually expands along its cross sectional length to at least the width of the nozzle array. The compression region of the gas flow duct gradually contracts along its cross sectional length.

15 Claims, 9 Drawing Sheets

DEFLECTION DEVICE INCLUDING EXPANSION AND CONTRACTION REGIONS

CROSS REFERENCE TO RELATED APPLICATIONS

Reference is made to commonly assigned U.S. patent application Ser. No. 08/222,583 filed concurrently herewith entitled "DEFLECTION DEVICE INCLUDING GAS FLOW RESTRICTION DEVICE" in the name of Michael S. Hanchak, incorporated herein by reference.

FIELD OF THE INVENTION

This invention relates generally to the field of digitally controlled printing devices, and in particular to continuous printing systems in which a liquid stream breaks into droplets at least some of which are deflected by a gas flow.

BACKGROUND OF THE INVENTION

In printing systems, for example, inkjet printing systems, it is critical to provide systems having predictable and accurate printed drop placement in order to reduce image defects and maintain print quality standards. Conditions which may lead to reduced printed drop placement accuracy resulting in increased image defects and reduced print quality should to be minimized.

SUMMARY OF THE INVENTION

The present invention helps to provide predictable and accurate printed drop placement by reducing turbulent gas flow in printing systems that use gas flow to deflect drops. Drop deflection or divergence can be adversely affected when turbulence is present in, for example, the interaction area of the drops and the gas flow force. Turbulent gas flow may increase or decrease the angle of drop deflection or divergence for both printed and non-printed drops which may lead to reduced drop placement accuracy, image defects, and poor print quality.

According to one aspect of the present invention, in a printing system that uses gas flow to deflect drops, a laminar flow of gas that has uniform velocity and directionality across a nozzle array is provided in a drop deflection zone so that drop deflection occurs in a predictable and accurate manner.

According to another aspect of the invention, a continuous printing system gas flow deflection mechanism includes a nozzle array, a gas flow source, and a gas flow duct. The nozzle array has a width. The gas flow duct is in fluid communication with the gas flow source and includes an expansion region and a compression region. The expansion region has a cross sectional length and a cross sectional width and includes a first portion and a second portion. The first portion of the gas flow duct is coupled to the gas flow source. The expansion region of the gas flow duct gradually expands along its cross sectional length, for example, to at least the width of the nozzle array, such that the cross sectional width of the expansion region in the second portion of the expansion region is greater than the cross sectional width of the expansion region in the first portion of the expansion region. The compression region has a cross section sectional length and a cross sectional width and includes a third portion and a fourth portion. The third portion of the compression region is adjacent to the second portion of the expansion region. The compression region of the gas flow duct gradually contracts along its cross sectional length such that the cross sectional width of the compression region in the fourth portion of the compression region is less than the cross sectional width of the compression region in the third portion of the compression region.

According to another aspect of the invention, a method of printing includes providing a nozzle array having a width; providing a gas flow duct in fluid communication with a gas flow source, the gas flow duct including an expansion region and a compression region, the expansion region having a cross sectional length and a cross sectional width, the expansion region including a first portion and a second portion, the first portion of the gas flow duct being coupled to the gas flow source, the expansion region of the gas flow duct gradually expanding along its cross sectional length to at least the width of the nozzle array such that the cross sectional width of the expansion region in the second portion of the expansion region is greater than the cross sectional width of the expansion region in the first portion of the expansion region, the compression region having a cross section sectional length and a cross sectional width, the compression region including a third portion and a fourth portion, the third portion of the compression region being adjacent to the second portion of the expansion region, the compression region of the gas flow duct gradually contracting along its cross sectional length such that the cross sectional width of the compression region in the fourth portion of the compression region is less than the cross sectional width of the compression region in the third portion of the compression region; causing liquid to be ejected in the form of a drop having a first volume and a drop having a second volume; and causing a gas flow generated by the gas flow source to flow through the gas flow duct and interact with the drop having a first volume and the drop having a second volume.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
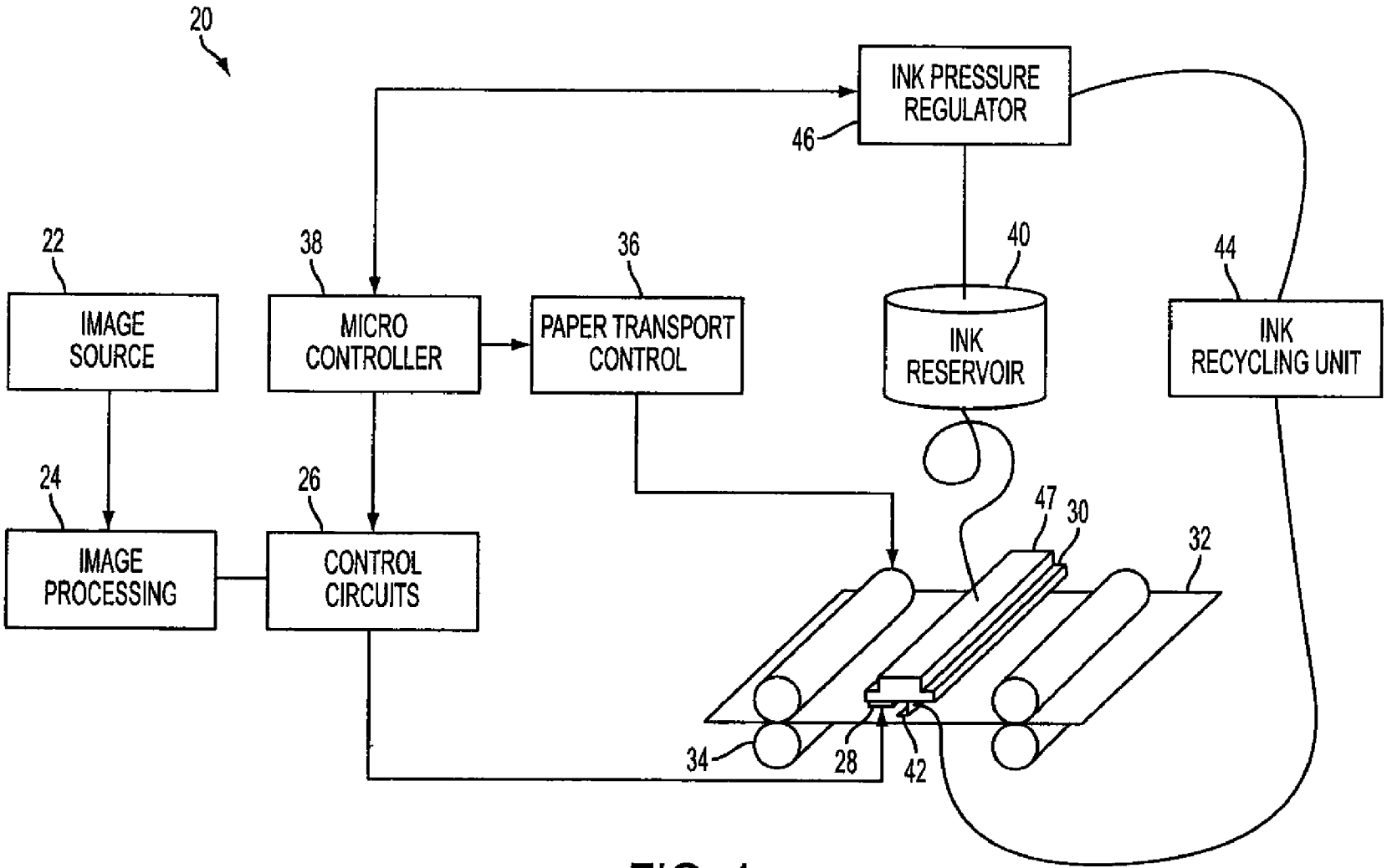
FIG. 1 shows a simplified schematic block diagram of an example embodiment of a printer system made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead and/or printhead components typically used in inkjet printing systems. However, many other applications are emerging which use inkjet printheads to emit liquids (other than inks) that need to be finely metered and deposited with high spatial precision. As such, as described herein, the terms "liquid" and/or "ink" refer to any material that can be ejected by the printhead and/or printhead components described below.

Referring to FIG. 1, a continuous printing system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. A plurality of drop forming mechanism control circuits 26 read data from the image memory and apply time-varying electrical pulses to a drop forming mechanism(s) 28 that are associated with one or more nozzles of a printhead 30. These pulses are applied at an appropriate time, and to the appropriate nozzle, so that drops formed from a continuous ink jet stream will form spots on a recording medium 32 in the appropriate position designated by the data in the image memory.

Recording medium 32 is moved relative to printhead 30 by a recording medium transport system 34, which is electronically controlled by a recording medium transport control system 36, and which in turn is controlled by a micro-controller 38. The recording medium transport system shown in FIG. 1 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 under pressure. In the non-printing state, continuous ink jet drop streams are unable to reach recording medium 32 due to an ink catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46. As shown in FIG. 1, catcher 42 is a type of catcher commonly referred to as a "knife edge" catcher.

The ink is distributed to printhead 30 through an ink channel 47. The ink preferably flows through slots and/or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism (not shown in FIG. 1) which is described in more detail below with reference to FIGS. 2 and 3.

Figure 2:
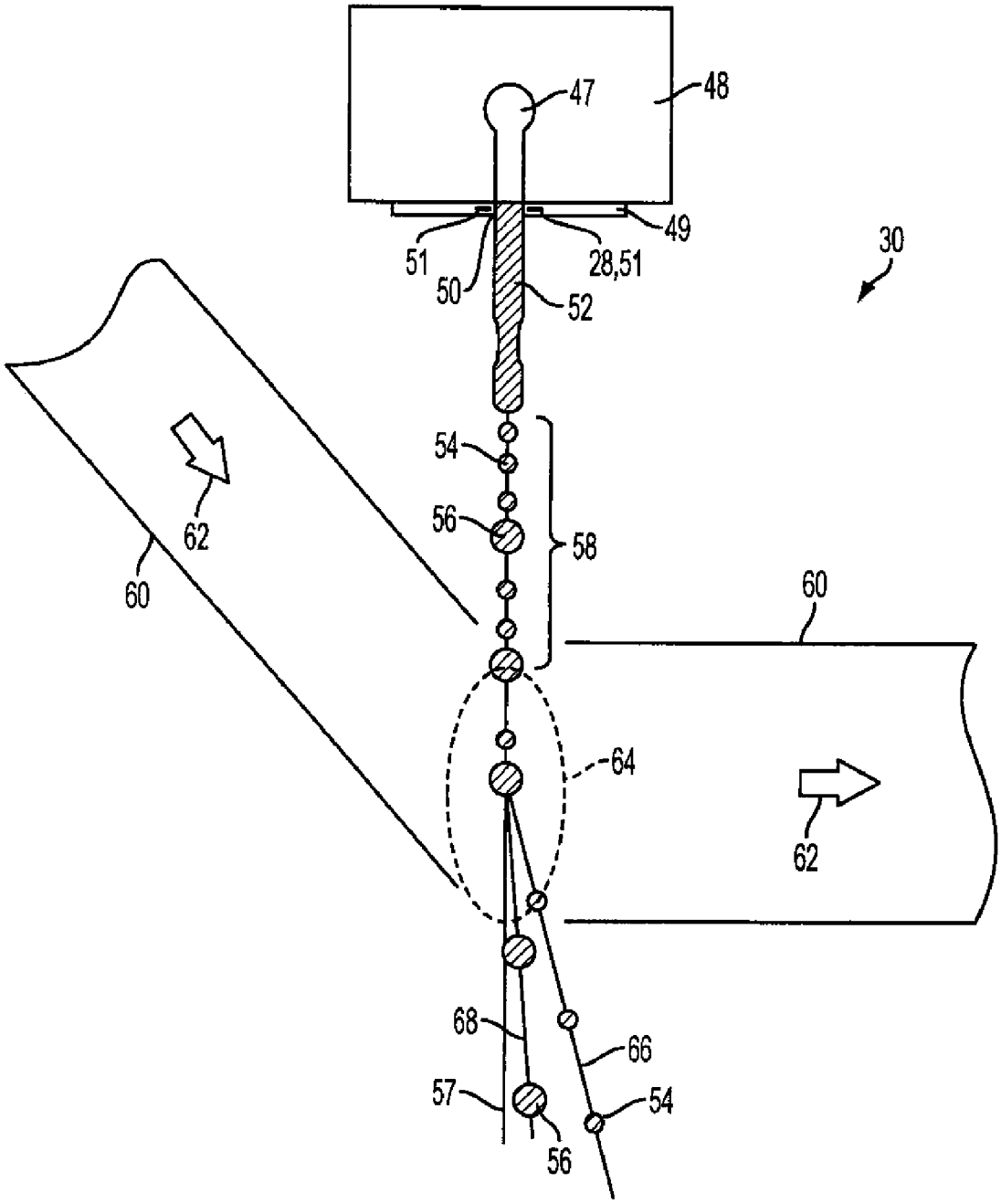
FIG. 2 is a schematic view of an example embodiment of a continuous printhead made in accordance with the present invention.
Figure 3:
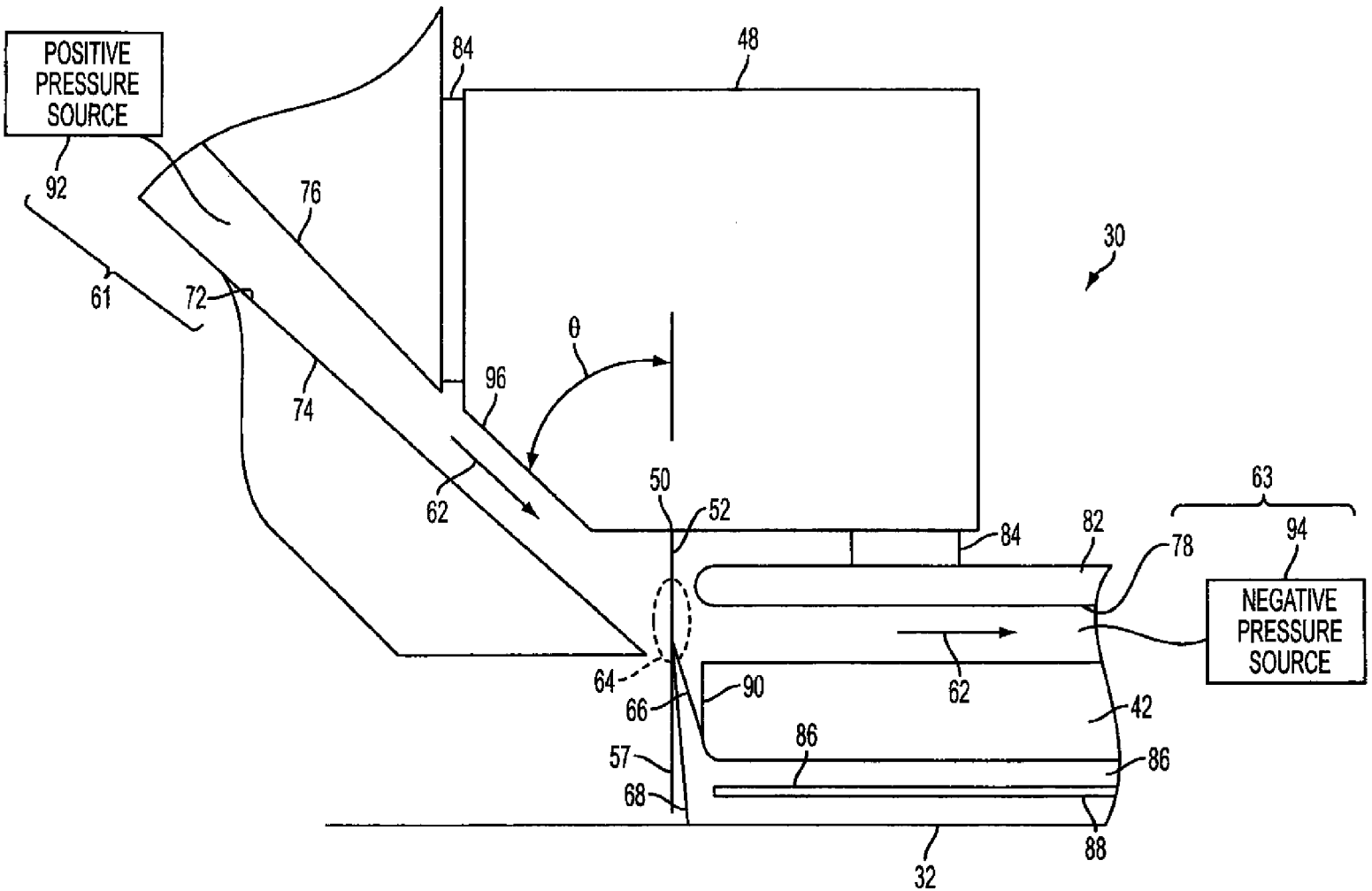
FIG. 3 is a schematic view of an example embodiment of a continuous printhead made in accordance with the present invention.

Referring to FIG. 2, a schematic view of continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, as shown in FIG. 3, nozzle plate 49 can be integrally formed with jetting module 48.

Liquid, for example, ink, is emitted under pressure through each nozzle 50 of the array to form filaments of liquid 52. In FIG. 2, the array or plurality of nozzles extends into and out of the figure.

Jetting module 48 is operable to form liquid drops having a first size and liquid drops having a second size through each nozzle. To accomplish this, jetting module 48 includes a drop stimulation or drop forming device 28, for example, a heater or a piezoelectric actuator, that, when selectively activated, perturbs each filament of liquid 52, for example, ink, to induce portions of each filament to breakoff from the filament and coalesce to form drops 54, 56.

In FIG. 2, drop forming device 28 is a heater 51 located in a nozzle plate 49 on one or both sides of nozzle 50. This type of drop formation is known and has been described in, for example, U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005, the disclosures of which are incorporated by reference herein.

Typically, one drop forming device 28 is associated with each nozzle 50 of the nozzle array. However, a drop forming device 28 can be associated with groups of nozzles 50 or all of nozzles 50 of the nozzle array.

When printhead 30 is in operation, drops 54, 56 are typically created in a plurality of sizes or volumes, for example, in the form of large drops 56, a first size or volume, and small drops 54, a second size or volume. The ratio of the mass of the large drops 56 to the mass of the small drops 54 is typically approximately an integer between 2 and 10. A drop stream 58 including drops 54, 56 follows a drop path or trajectory 57.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64 it alters the drop trajectories. As the drop trajectories pass out of the deflection zone 64 they are traveling at an angle, called a deflection angle, relative to the undeflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that catcher 42 (shown in FIGS. 1 and 3) can be positioned to intercept one of the small drop trajectory 66 and the large drop trajectory 68 so that drops following the trajectory are collected by catcher 42 while drops following the other trajectory bypass the catcher and impinge a recording medium 32 (shown in FIGS. 1 and 3).

When catcher 42 is positioned to intercept large drop trajectory 68, small drops 54 are deflected sufficiently to avoid contact with catcher 42 and strike the print media. As the small drops are printed, this is called small drop print mode. When catcher 42 is positioned to intercept small drop trajectory 66, large drops 56 are the drops that print. This is referred to as large drop print mode.

Referring to FIG. 3, jetting module 48 includes an array or a plurality of nozzles 50. Liquid, for example, ink, supplied through channel 47, is emitted under pressure through each nozzle 50 of the array to form filaments of liquid 52. In FIG. 3, the array or plurality of nozzles 50 extends into and out of the figure.

Drop stimulation or drop forming device 28 (shown in FIGS. 1 and 2) associated with jetting module 48 is selectively actuated to perturb the filament of liquid 52 to induce portions of the filament to break off from the filament to form drops. In this way, drops are selectively created in the form of large drops and small drops that travel toward a recording medium 32.

Positive pressure gas flow structure 61 of gas flow deflection mechanism 60 is located on a first side of drop trajectory 57. Positive pressure gas flow structure 61 includes first gas flow duct 72 that includes a lower wall 74 and an upper wall 76. Gas flow duct 72 directs gas flow 62 supplied from a positive pressure source 92 at downward angle θ of approximately a 45° relative to liquid filament 52 toward drop deflection zone 64 (also shown in FIG. 2). An optional seal(s) 84 provides an air seal between jetting module 48 and upper wall 76 of gas flow duct 72.

Upper wall 76 of gas flow duct 72 does not need to extend to drop deflection zone 64 (as shown in FIG. 2). In FIG. 3, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure includes a second gas flow duct 78 located between catcher 42 and an upper wall 82 that exhausts gas flow from deflection zone 64. Second duct 78 is connected to a negative pressure source 94 that is used to help remove gas flowing through second duct 78. An optional seal(s) 84 provides an air seal between jetting module 48 and upper wall 82.

As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by first gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of catcher 42. Small drops 54 contact face 90 and flow down face 90 and into a liquid return duct 86 located or formed between catcher 42 and a plate 88. Collected liquid is either recycled and returned to ink reservoir 40 (shown in FIG. 1) for reuse or discarded. Large drops 56 bypass catcher 42 and travel on to recording medium 32. Alternatively, catcher 42 can be positioned to intercept large drop trajectory 68. Large drops 56 contact catcher 42 and flow into a liquid return duct located or formed in catcher 42. Collected liquid is either recycled for reuse or discarded.

As shown in FIG. 3, catcher 42 is a type of catcher commonly referred to as a "Coanda" catcher. However, the "knife edge" catcher shown in FIG. 1 and the "Coanda" catcher shown in FIG. 3 are interchangeable and work equally well. Alternatively, catcher 42 can be of any suitable design including, but not limited to, a porous face catcher, a delimited edge catcher, or combinations of any of those described above.

Figure 4:
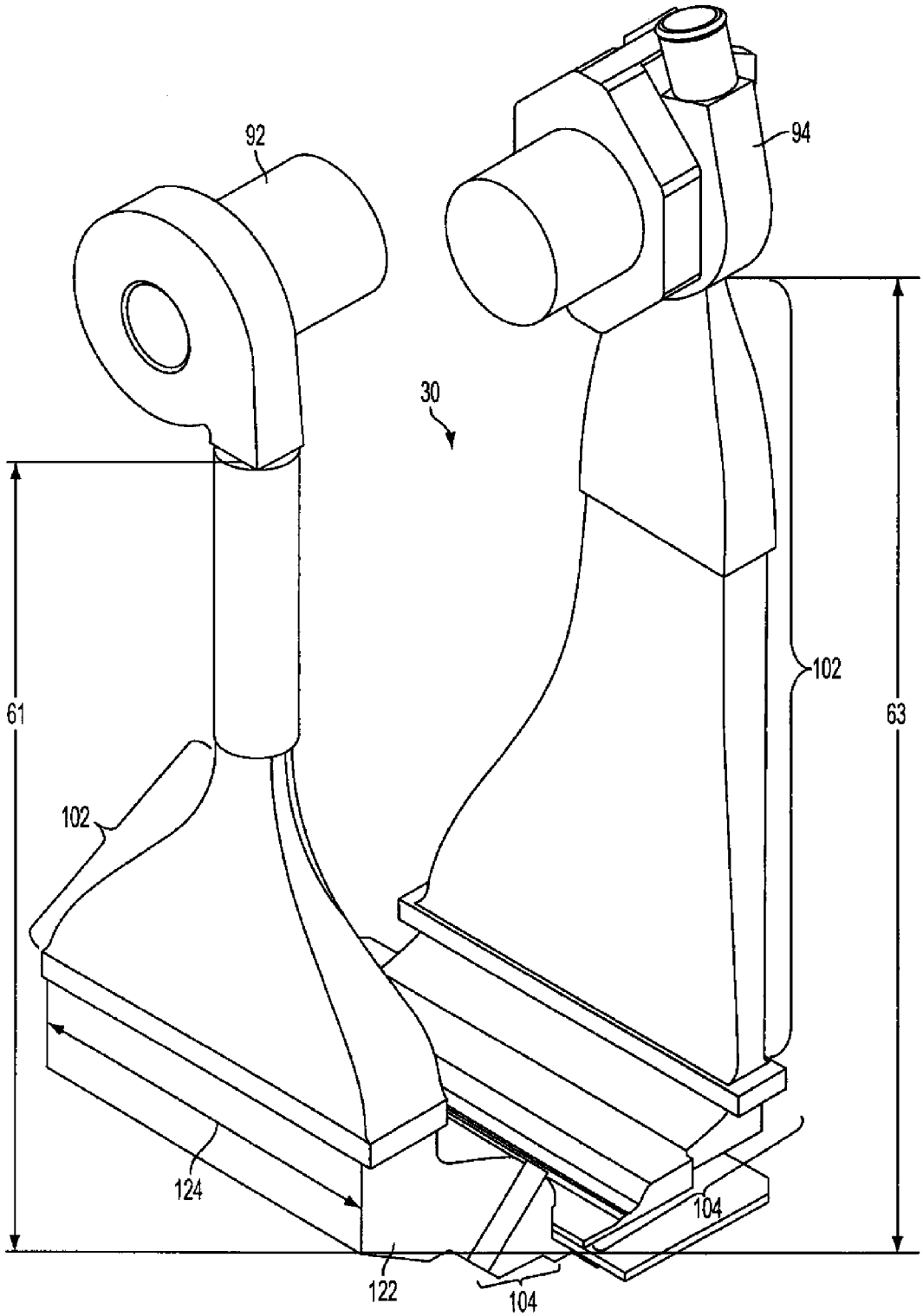
FIG. 4 is a schematic perspective view of an example embodiment of the present invention.
Figure 5:
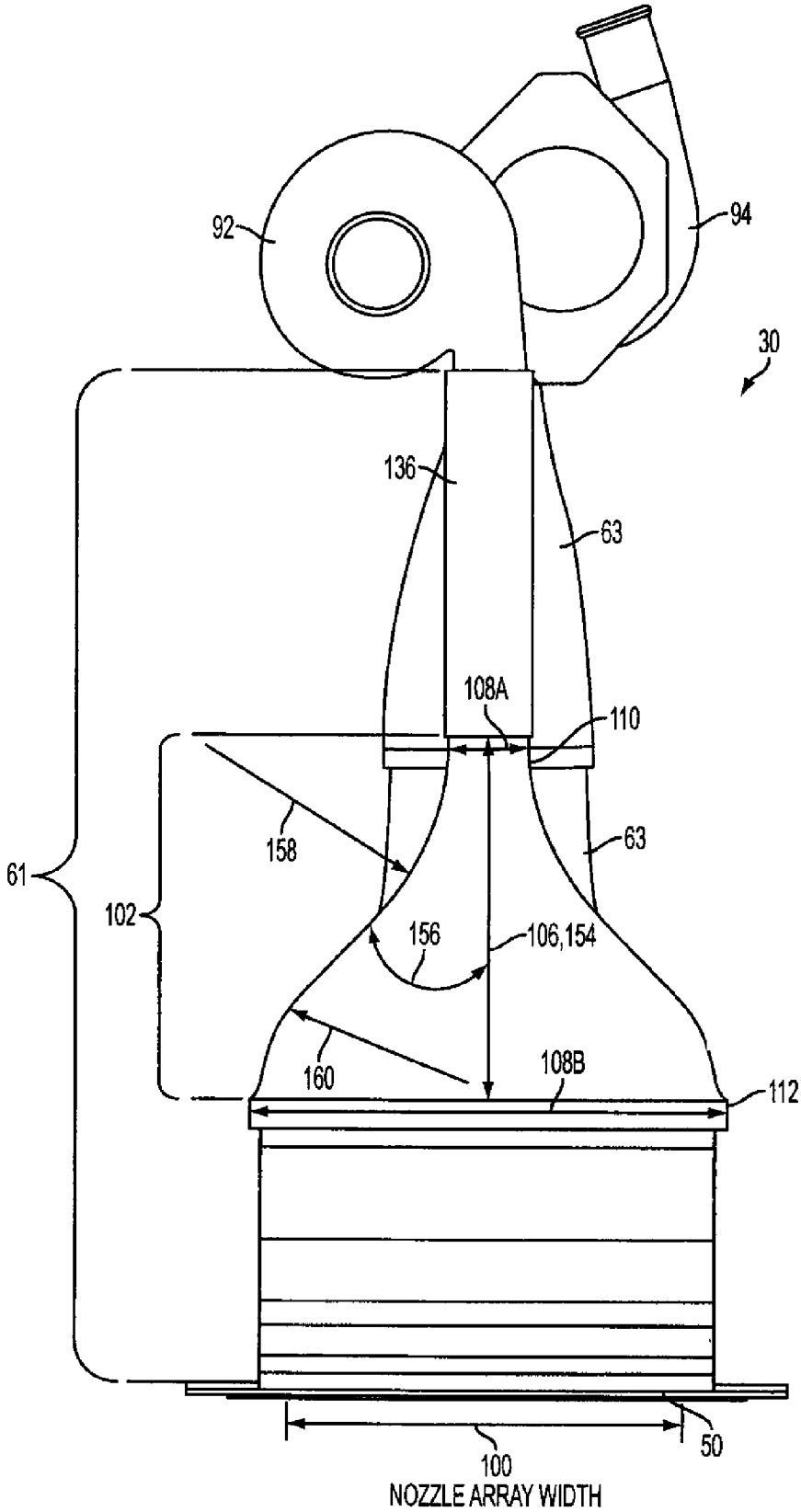
FIG. 5 is a schematic front view of the example embodiment of the present invention shown in FIG. 4.
Figure 6:
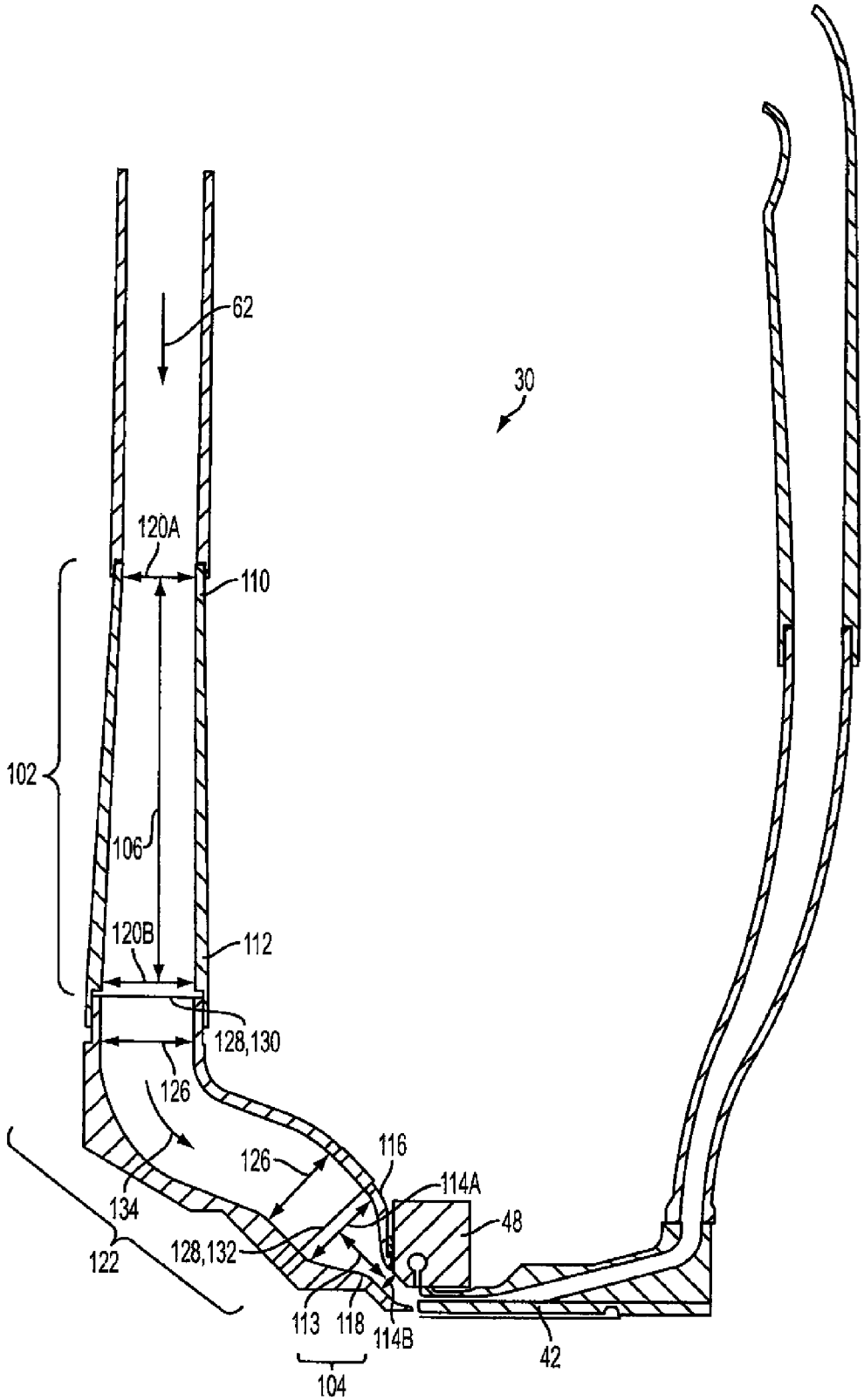
FIG. 6 is a schematic cross-sectional side view of the example embodiment of the present invention shown in FIGS. 4 and 5.

Referring to FIGS. 4-6, an example embodiment of the present invention is shown. Generally described, the present invention relates to a gas flow duct structure, in fluid communication with a gas flow source, that includes an expansion region 102 and a compression region 104. Configuring a gas flow duct structure in this fashion helps to reduce and/or control gas flow turbulence described above.

The gas flow source can be a positive pressure gas flow source 92 that directs a gas flow 62 toward the compression region 104 of a positive pressure gas flow duct structure 61. Alternatively, the gas flow source can be a negative pressure gas flow source 94 that directs a gas flow 62 away from the compression region 104 of a negative pressure gas flow duct structure 63. As such, the present invention is described herein with reference to a positive pressure gas flow source 92 and a positive pressure gas flow duct structure 61. However, it is to be understood that the present invention is also applicable to a negative pressure gas flow duct structure 63 and a negative pressure gas flow duct structure 63.

Printhead 30 includes nozzle array 50 having a width 100. A gas flow duct structure 61, in fluid communication with a gas flow source 92, includes an expansion region 102 and a compression region 104.

Expansion region 102, having a cross sectional length 106 and a cross sectional width 108A, 108B, includes a first portion 110 and a second portion 112. First portion 110 of expansion region 102 of gas flow duct 61 is coupled to gas flow source 92 through duct structure 136. Expansion region 102 of gas flow duct 61 gradually expands along its cross sectional length 106 to at least the width 100 of nozzle array 50 as viewed from first portion 110 of expansion region 102 toward second portion 112 of expansion region 102. Cross sectional width 108B of expansion region 102 in second portion 112 of expansion region 102 is greater than cross sectional width 108A of expansion region 102 in first portion 110 of expansion region 102 of gas flow duct 61.

As used herein, gradually expands means that, at a minimum, the width (from 108A to 108B) of the gas flow path is increased at a non-perpendicular angle 156 relative to a centerline 154 of the gas flow path. Preferably, the non-perpendicular angle of expansion 156 is less than 60 degrees relative to the centerline, and more preferably less than 45 degrees. Providing a non-perpendicular angle of expansion 156 reduces gas flow velocity and increases the cross section of gas flow while minimizing the introduction of turbulent gas flow into gas flow path. This can be contrasted with the abrupt and immediate expansion described in, for example, U.S. Pat. No. 4,297,712, issued to Lammers et al., on Oct. 27, 1981. As shown in FIG. 2 of the '712 reference, a gas 50 flows from conduit 74 to settling chamber 72. The angle of expansion is perpendicular relative to a centerline of conduit 74 which introduces turbulence into settling chamber 72.

It is preferable that the definition of gradually expands also include that the individual radii of the curvature 158, 160 between different portions of the expansion region are greater than 0.5 times the cross sectional width 108A in the first portion of the expansion region 102 with adjacent curves 158, 160 meeting at the tangent of the curves. More preferably, the individual radii of curvature 158, 160 are greater than 2 times the inlet width, and more preferably, greater than 3 times the inlet width.

Gradually expanding expansion region 102 of gas flow duct 61 along its cross sectional length 106 preferably causes the length of the expansion region to be greater than 3 times the inlet width, and more preferably approximately 6 times the inlet width while still maintaining a relatively compact footprint.

Figure 9:
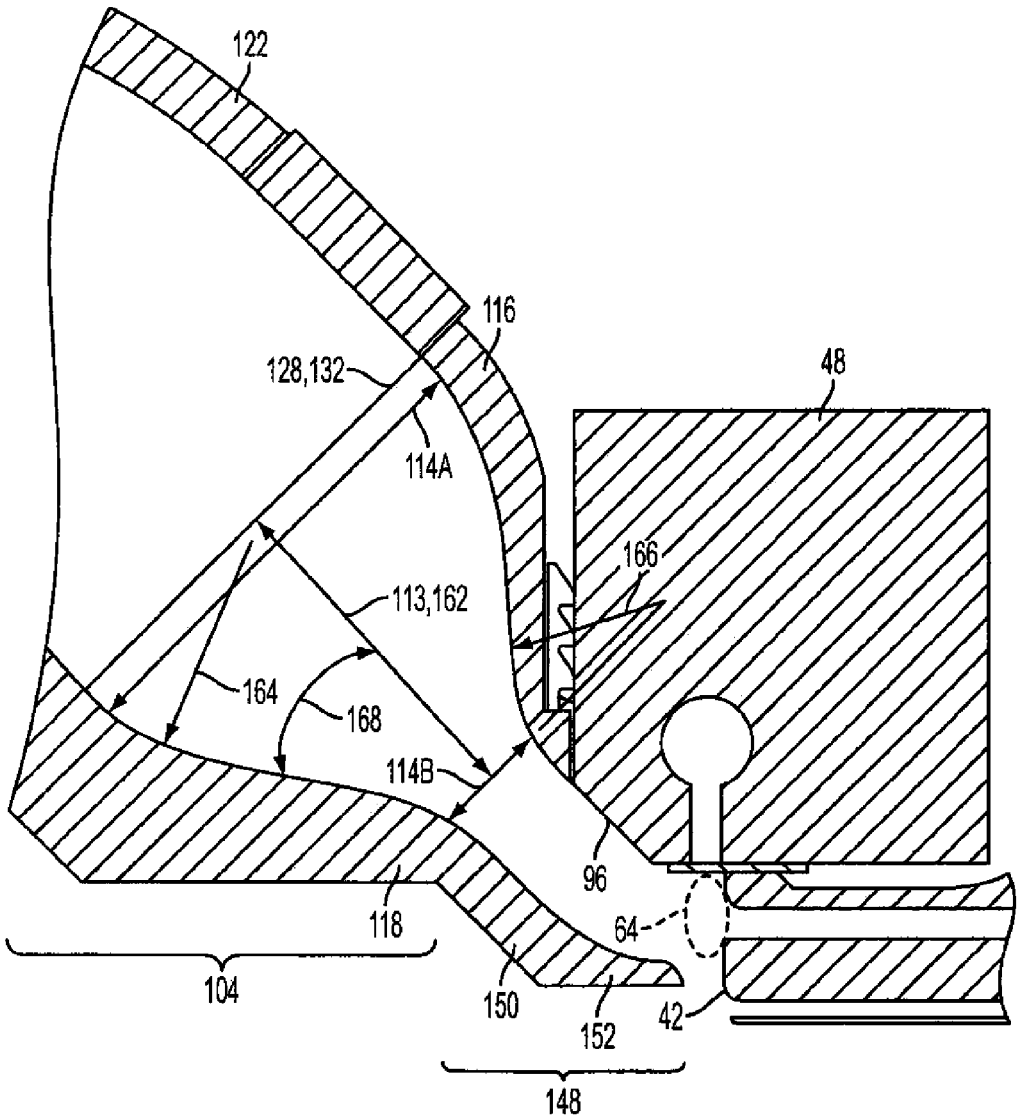
FIG. 9 is a schematic cross-sectional side view of a portion of the example embodiment of the present invention shown in FIGS. 4-7.

Referring additionally to FIG. 9 and back to FIGS. 4-6, compression region 104, having a cross section sectional length 113 and a cross sectional width 114A, 114B, includes a third portion 116 and a fourth portion 118. Third portion 116 of the compression region 104 is adjacent to second portion 112 of expansion region 102. Compression region 104 of gas flow duct 61 gradually contracts along its cross sectional length 113 as viewed from third portion 116 of the compression region 104 toward fourth portion 118 of the compression region 104. Cross sectional width 114B of compression region 104 in the fourth portion 118 of the compression region 104 is less than the cross sectional width 114A of the compression region 104 in the third portion 116 of the compression region 104.

As used herein, gradually contracts means that, at a minimum, the width (from 114A to 114B) of the gas flow path is decreased at a non-perpendicular angle 168 relative to a centerline 162 of the gas flow path. Preferably, the non-perpendicular angle of contraction 168 is less than 60 degrees relative to the centerline, and more preferably less than 38 degrees. Providing a non-perpendicular angle of contraction 168 increases gas flow velocity and reduces velocity variations while minimizing or even preventing the introduction of turbulent gas flow into gas flow path. For example, as shown in FIG. 9, the cross sectional width 114B of the fourth portion 118 of the compression region 104 is less than or equal to one half of the cross sectional width 114A of the third portion 116 of the compression region 104.

It is preferable that the definition of gradually contracts also include that the individual radii of the curvature 164, 166 between different portions of the expansion region are greater than 0.5 times the cross sectional width 114B in the second portion of the contraction region 104 with adjacent curves 164, 166 meeting at the tangent of the curves. More preferably, the individual radii of curvature 164, 166 are greater than 1 times the cross sectional width 114B.

After the gas flow passes through compression region 104, it travels through duct structure 148 that includes a duct wall 150 that is parallel to wall 96 of the jetting module 48. This parallel flow region (defined by duct wall 150 and jetting module wall 96) helps to maintain the uniform velocity and directionality of the gas flow. As the flow path moves through a curve or change in direction, a portion 152 of duct wall 150 is curved or otherwise appropriately shaped to maintain the parallel flow region and the uniform velocity and directionality of the gas flow in the area immediately adjacent to deflection zone 64.

Figure 8A:
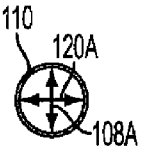
FIGS. 8A-8K are schematic cross-sectional views of the example embodiment shown in FIG. 7 taken along the corresponding section lines shown in FIG. 7.

In some example embodiments, cross sectional width 108A, 108B of expansion region 102 is a first cross sectional width 108A, 108B. Expansion region 102 also includes a second cross sectional width 120A, 120B. In these embodiments, expansion region 102 of the gas flow duct 61 expands along its cross sectional length 106 as viewed from first portion 110 of expansion region 102 toward second portion 112 of expansion region 102. The second cross sectional width 120B of expansion region 102 in second portion 112 of expansion region 102 is greater than second cross sectional width 120A of expansion region 102 in the first portion 110 of expansion region 102 (also shown in FIGS. 8A and 8C). In these example embodiments, the cross sectional width 114A, 114B of compression region 104 and the second cross sectional width 120A, 120B of the expansion region 102 are viewed in the same plane (typically, a plane perpendicular to the direction of drop path 57, for example, the plane shown in FIG. 6).

As described above, third portion 116 of compression region 104 is adjacent to second portion 112 of expansion region 102. In this sense, third portion 116 of compression region 104 can be either positioned next to second portion 112 of expansion region 102 (as shown with reference to negative pressure gas flow structure 63) or a third region 122 can be positioned between second portion 112 of expansion region 102 and third portion 116 of compression region 104 (as shown with reference to positive pressure gas flow structure 61).

Third region 122 of gas flow duct 61 has a substantially uniform cross sectional length 124 and a substantially uniform cross sectional width 126. Providing third region 122 with a substantially uniform cross sectional length 124 and a substantially uniform cross sectional width 126 facilitates positioning a flow conditioner(s) 128 in third region 122 of gas flow duct 61 and changing the direction of gas flow 62. As shown in FIG. 6, flow conditioner(s) 128 includes a first screen 130 and a second screen 132 positioned perpendicular to the direction of gas flow 62 through third region 122 of the gas flow duct 61. First screen 130 and a second screen 132 should be uniformly tensioned in both directions along the cross sectional width 126 and cross sectional length 124 of the third region 122 of gas flow duct 61. Additionally, the weave of the screen should be at a non-perpendicular non-parallel angle relative to the walls of third region 122 of gas flow duct 61. For example, the weave of the screens is preferably between 30 degrees and 60 degrees, and more preferably approximately 45 degrees. The resolution of the weave of the screen is preferably greater than 0.75 times the width of the nozzle array.

Flow conditioner(s) 128, for example, first screen 130 and second screen 132, help to make the gas flow velocity uniform across the nozzle array width 100 by providing a static pressure drop across each screen. It is also believed that the build up of back pressure behind flow conditioner(s) 128 helps to reduce the likelihood of gas flow detaching from the duct walls in expansion region 102 which also helps to reduce turbulent gas flow. Screens 130 and 132 can be made from metal, nylon, polyester, or other polymer materials.

Alternatively, flow conditioner(s) 128 can include flow straighteners, open celled foams, or combinations of any flow conditioners previously mentioned. Third region 122 of gas flow duct 61, commonly referred to as a settling chamber, is also shaped to change the direction of gas flow 62 (represented using arrow 134).

Figure 7:
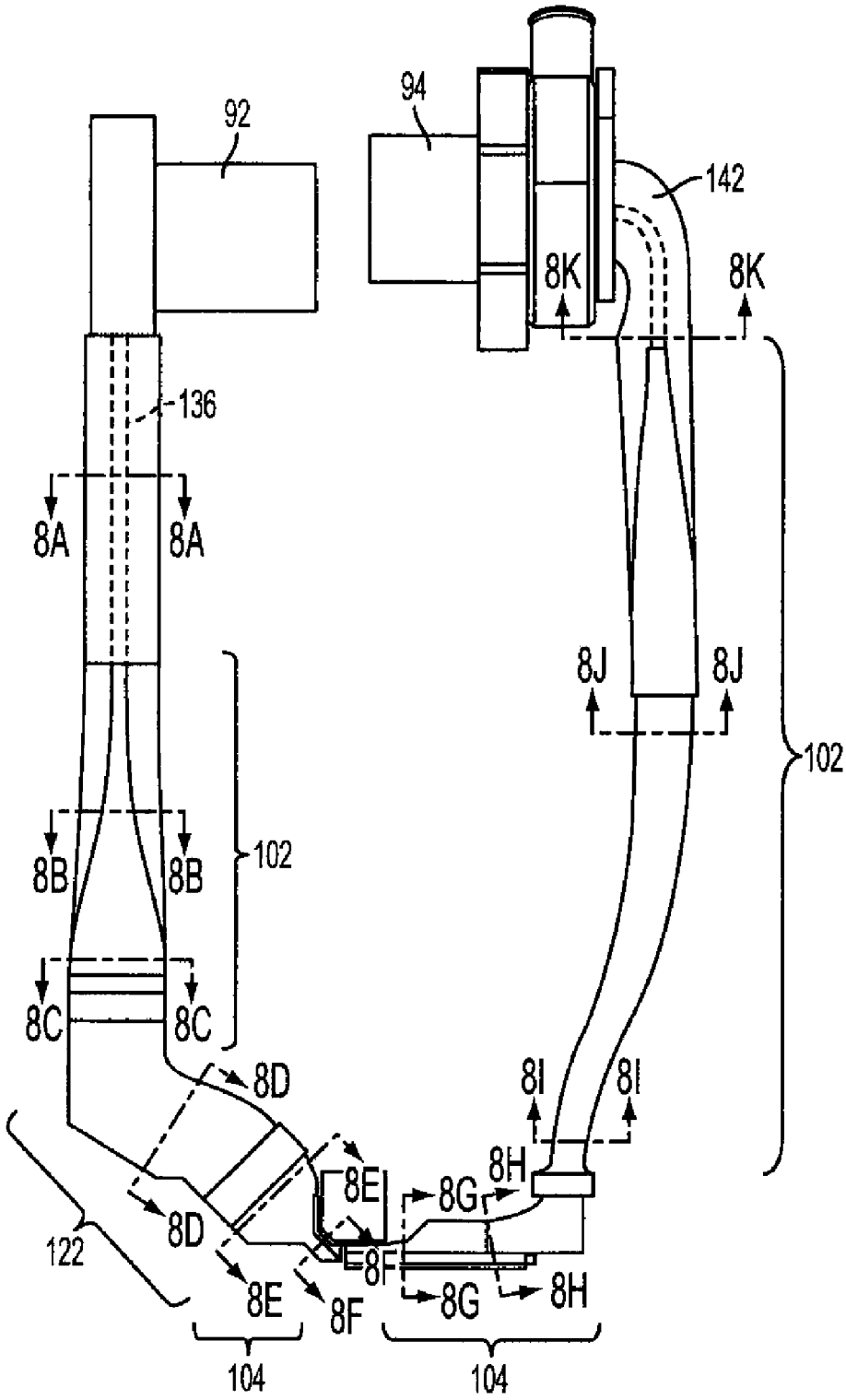
FIG. 7 is a schematic side view of the example embodiment of the present invention shown in FIGS. 4-6.

Referring to FIG. 7 and FIGS. 8A-8K, the example embodiment of the present invention described above with reference to FIGS. 4-6 is shown along with schematic cross-sectional views of the example embodiment taken along the corresponding section lines shown in FIG. 7.

Duct structure 136 is typically used to extend the path of gas flow 62 so that positive pressure source 92 can be conveniently located. The cross sectional width of the gas flow path in duct structure 136 is the same as the cross sectional width 108A of expansion region 102 in first portion 110 of expansion region 102 of gas flow duct 61.

Duct structure 142 is typically used to extend the path of gas flow 62 so that negative pressure source 94 can be conveniently located. The cross sectional width of the gas flow path in duct structure 142 is the same as the cross sectional width 108A of expansion region 102 in first portion 110 of expansion region 102 of gas flow duct 63.

As shown in FIGS. 7 and 8A-8K, first portion 110 of expansion region 102 of positive pressure gas flow duct structure 61 has cross sectional width 108A (FIG. 8A) that gradually expands (FIG. 8B) along its cross sectional length 106 until cross sectional width 108B (FIG. 8C) of second portion 112 of expansion region 102 is at least the width 100 of nozzle array 50. Cross sectional width 108B of second portion 112 of expansion region 102 is greater than cross sectional width 108A of first portion 110 of expansion region 102.

Third region 122 of gas flow duct 61 has a substantially uniform cross sectional length 124 (FIG. 8D) that is essentially equivalent to cross sectional width 108B of second portion 112 of expansion region 102 and maintained through the cross sectional width 114A (FIG. 8E) of the third portion 116 of the compression region 104. Compression region 104 of gas flow duct 61 then gradually contracts along its cross sectional length 113 until cross sectional width 114B (FIG. 8F) of the fourth portion 118 of the compression region 104 is less than the cross sectional width 114A of the third portion 116 of the compression region 104. Positive pressure gas flow source 92 directs gas flow 62 toward the compression region 104 of positive pressure gas flow duct structure 61.

First portion 110 of expansion region 102 of negative pressure gas flow duct structure 63 has cross sectional width 108A (FIG. 8K) that gradually expands (FIG. 8J) along its cross sectional length 106 until cross sectional width 108B (FIG. 8I) of second portion 112 of expansion region 102 is at least the width 100 of nozzle array 50 and/or is greater than cross sectional width 108A of first portion 110 of expansion region 102.

Compression region 104 of gas flow duct 63 gradually contracts along its cross sectional length 113 until cross sectional width 114B (FIG. 8G) of the fourth portion 118 of the compression region 104 is less than the cross sectional width 114A (FIG. 8H) of the third portion 116 of the compression region 104. Negative pressure gas flow source 94 directs gas flow 62 away from the compression region 104 of negative pressure gas flow duct structure 63.

Figure 8B:
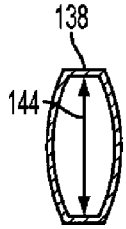
Figure 8C:
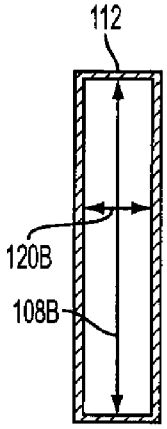
Figure 8D:
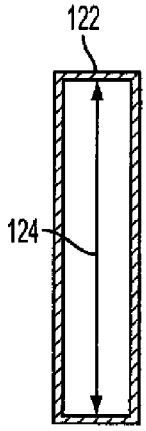
Figure 8E:
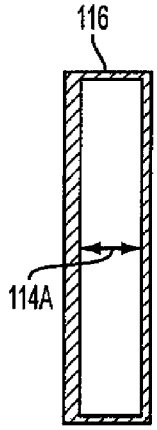
Figure 8F:
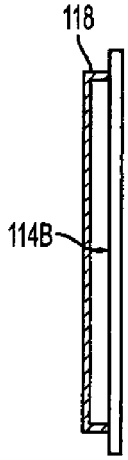
Figure 8G:
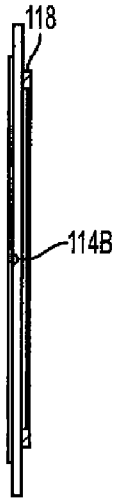
Figure 8H:
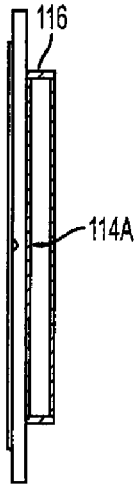
Figure 8I:
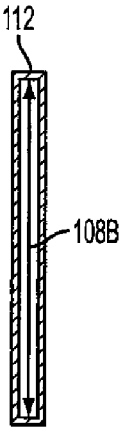
Figure 8J:
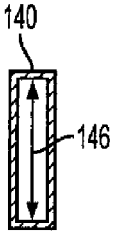
Figure 8K:
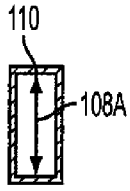

FIGS. 7 and 8B also show an intermediate portion 138 of expansion region 102 of positive pressure gas flow duct 61. Intermediate portion 138 of expansion region 102 has a cross sectional width 144 that is greater than cross sectional width 108A of first portion 110 of expansion region 102 and less than cross sectional width 108B of second portion 112 of expansion region 102. FIGS. 7 and 8J also show an intermediate portion 140 of expansion region 102 of negative pressure gas flow duct 63. Intermediate portion 140 of expansion region 102 has a cross sectional width 146 that is greater than cross sectional width 108A of first portion 110 of expansion region 102 and less than cross sectional width 108B of second portion 112 of expansion region 102.

Inclusion of intermediate portions 138 and 140 also helps to illustrate the gradual expansion of expansion region 102 in that it shows that there is not an abrupt or immediate expansion of the gas flow path (as shown and detailed in the prior art references described above). Instead, the expansion of the gas flow path in expansion region 102 is a gradual change from the initial cross sectional width to the final cross sectional width (as described above).

Referring back to FIGS. 4-8K, gas flow duct 61 (and 63) is typically assembled from a plurality of individual flow ducts, typically, made from a polymer material. In order to further reduce turbulent gas flow, it is important to minimize steps or discontinuities when assembling the individual ducts. Additionally, the interior surfaces of the individual duct portions are polished, for example, to less than a $65\times10^{-6}$ inch RMS roughness in order to minimize turbulent gas flow. This degree of surface roughness is very important in the positive pressure gas flow duct structure 61 in order to minimize turbulent gas flow after the gas flow passes through flow conditioner(s) 128 because there is no other device that can minimize turbulent gas flow if turbulent gas flow re-develops prior to the gas flow entering the drop deflection zone 64.

The invention has been described in detail with particular reference to certain preferred embodiments thereof, but it will be understood that variations and modifications can be effected within the scope of the invention.

PARTS LIST

20 continuous printing system
22 image source
24 image processing unit
26 mechanism control circuits
28 device
30 printhead
32 recording medium
34 recording medium transport system
36 recording medium transport control system
38 micro-controller
40 reservoir
42 catcher
44 recycling unit
46 pressure regulator
47 channel
48 jetting module
49 nozzle plate
50 plurality of nozzles
51 heater
52 liquid
54 drops
56 drops
57 trajectory
58 drop stream
60 gas flow deflection mechanism
61 positive pressure gas flow structure
62 gas flow
63 negative pressure gas flow structure
64 deflection zone
66 small drop trajectory
68 large drop trajectory
72 first gas flow duct
74 lower wall
76 upper wall
78 second gas flow duct
82 upper wall
86 liquid return duct
88 plate
90 front face
92 positive pressure source
94 negative pressure source
96 wall
100 width
102 expansion region
104 compression region
106 cross sectional length
108A cross sectional width
108B cross sectional width

110 first portion
112 second portion
113 cross section sectional length
114A cross sectional width
114B cross sectional width
116 third portion
118 fourth portion
120A second cross sectional width
120B second cross sectional width
122 third region
124 substantially uniform cross sectional length
126 substantially uniform cross sectional width
128 flow conditioner
130 first screen
132 second screen
134 arrow
136 duct structure
138 intermediate portion of expansion region
140 intermediate portion of expansion region
142 duct structure
144 cross sectional width
146 cross sectional width
148 duct structure
150 duct wall
152 portion
154 centerline
156 non-perpendicular angle
158 radius of curvature
160 radius of curvature
162 centerline
164 radius of curvature
166 radius of curvature
168 non-perpendicular angle

The invention claimed is:

1. A printhead comprising:

a nozzle array having a width;

a gas flow source; and a gas flow duct in fluid communication with the gas flow source, the gas flow duct including an expansion region and a compression region, the expansion region having a cross sectional length and a cross sectional width, the expansion region including a first portion and a second portion, the first portion of the gas flow duct being coupled to the gas flow source, the expansion region of the gas flow duct gradually expanding along its cross sectional length to at least the width of the nozzle array such that the cross sectional width of the expansion region in the second portion of the expansion region is greater than the cross sectional width of the expansion region in the first portion of the expansion region, the compression region having a cross section sectional length and a cross sectional width, the compression region including a third portion and a fourth portion, the third portion of the compression region being adjacent to the second portion of the expansion region, the compression region of the gas flow duct gradually contracting along its cross sectional length such that the cross sectional width of the compression region in the fourth portion of the compression region is less than the cross sectional width of the compression region in the third portion of the compression region.

2. The printhead of claim 1, the cross sectional width of the expansion region being a first cross sectional width, the expansion region having a second cross sectional width, wherein the expansion region of the gas flow duct gradually expands along its cross sectional length such that the second cross sectional width of the expansion region in the second portion of the expansion region is greater than the second cross sectional width of the expansion region in the first portion of the expansion region.

3. The printhead of claim 2, wherein the cross sectional width of the compression region and the second cross sectional width of the expansion region are viewed in the same plane.

4. The printhead of claim 1, the gas flow duct further comprising:

a third region positioned between the second portion of the expansion region and the third portion of the compression region, the third region having a substantially uniform cross sectional length and a substantially uniform cross sectional width.

5. The printhead of claim 4, further comprising:

a flow conditioner positioned in the third region of the gas flow duct.

6. The printhead of claim 5, wherein the flow conditioner includes a first screen and a second screen positioned perpendicular to a direction of gas flow through the third region of the gas flow duct.

7. The printhead of claim 4, wherein the third region of the gas flow duct includes changes the direction of gas flow.

8. The printhead of claim 5, the third region of the gas flow duct including walls, the flow conditioner comprising a screen having a weave, wherein the weave of the screen is at a non-perpendicular non-parallel angle relative to the walls of third region of gas flow duct.

9. The printhead of claim 5, the third region of the gas flow duct including a cross sectional width and a cross sectional length, the flow conditioner comprising a screen, wherein the screen is uniformly tensioned in directions along the cross sectional width and the cross sectional length of the third region.

10. The printhead of claim 1, wherein the cross sectional width of the fourth portion of the compression region is less than or equal to one half of the cross sectional width of the third portion of the compression region.

11. The printhead of claim 1, wherein the gas flow source directs the gas flow toward the compression region of the gas flow duct.

12. The printhead of claim 1, wherein the gas flow source directs the gas flow away from the compression region of the gas flow duct.

13. A continuous printing system gas flow deflection mechanism comprising:

a gas flow source; and a gas flow duct in fluid communication with the gas flow source, the gas flow duct including an expansion region and a compression region, the expansion region having a cross sectional length and a cross sectional width, the expansion region including a first portion and a second portion, the first portion of the gas flow duct being coupled to the gas flow source, the expansion region of the gas flow duct gradually expanding along its cross sectional length such that the cross sectional width of the expansion region in the second portion of the expansion region is greater than the cross sectional width of the expansion region in the first portion of the expansion region, the compression region having a cross section sectional length and a cross sectional width, the compression region including a third portion and a fourth portion, the third portion of the compression region being adjacent to the second portion of the expansion region, the compression region of the gas flow duct gradually contracting along its cross sectional length such that the cross sectional width of the compression region in the fourth portion of the compression region is less than the cross sectional width of the compression region in the third portion of the compression region.

14. The deflection mechanism of claim 13, wherein the expansion region of the gas flow duct gradually expands along its cross sectional length to at least the width of a nozzle array such that the cross sectional width of the expansion region in the second portion of the expansion region is greater than the cross sectional width of the expansion region in the first portion of the expansion region, the nozzle array being removably associated with the gas flow duct.

15. A method of printing comprising:

providing a nozzle array having a width;

providing a gas flow duct in fluid communication with a gas flow source, the gas flow duct including an expansion region and a compression region, the expansion region having a cross sectional length and a cross sectional width, the expansion region including a first portion and a second portion, the first portion of the gas flow duct being coupled to the gas flow source, the expansion region of the gas flow duct gradually expanding along its cross sectional length to at least the width of the nozzle array such that the cross sectional width of the expansion region in the second portion of the expansion region is greater than the cross sectional width of the expansion region in the first portion of the expansion region, the compression region having a cross section sectional length and a cross sectional width, the compression region including a third portion and a fourth portion, the third portion of the compression region being adjacent to the second portion of the expansion region, the compression region of the gas flow duct gradually contracting along its cross sectional length such that the cross sectional width of the compression region in the fourth portion of the compression region is less than the cross sectional width of the compression region in the third portion of the compression region;

causing liquid to be ejected in the form of a drop having a first volume and a drop having a second volume; and causing a gas flow generated by the gas flow source to flow through the gas flow duct and interact with the drop having a first volume and the drop having a second volume.

* * * * *